United States Patent [19]

Geurian

[11] 4,211,136

[45] Jul. 8, 1980

[54] CUTTER ASSEMBLY FOR SAW CHAIN

[76] Inventor: Grady O. Geurian, 1305 N. Front, Dardanelle, Ark. 72834

[21] Appl. No.: 903,545

[22] Filed: May 8, 1978

[51] Int. Cl.[2] ..... B27B 33/14

[52] U.S. Cl. ..... 83/830

[58] Field of Search ..... 83/830, 831, 832, 833, 83/834

[56] References Cited

U.S. PATENT DOCUMENTS

| | | | |
|---|---|---|---|
| 2,632,484 | 3/1953 | Merz | 83/834 |
| 2,705,512 | 4/1955 | Wolf | 83/834 |
| 3,040,789 | 6/1962 | Mall et al. | 83/833 |
| 3,261,385 | 7/1966 | Cooper | 83/834 |
| 4,081,009 | 3/1978 | Curlett | 83/830 X |

*Primary Examiner*—Donald R. Schran

*Attorney, Agent, or Firm*—Clarence A. O'Brien; Harvey B. Jacobson

[57] ABSTRACT

A saw chain is constructed by a cutter assembly having a first cutter member and a second cutter member arranged sequentially and attached together by an attachment arrangement including a pair of links, a pair of pins, and suitable rollers. The cutter members each include a cutter and a driver, with the latter being receivable in a peripheral groove of a cutter bar. The cutters of each of the cutter members extend away from one another so as to form an alternate bite along the length of the resulting saw chain. The disposition of the cutter members centrally of the links provide improved balance to a saw chain constructed from links according to the invention.

4 Claims, 4 Drawing Figures

Fig. 1
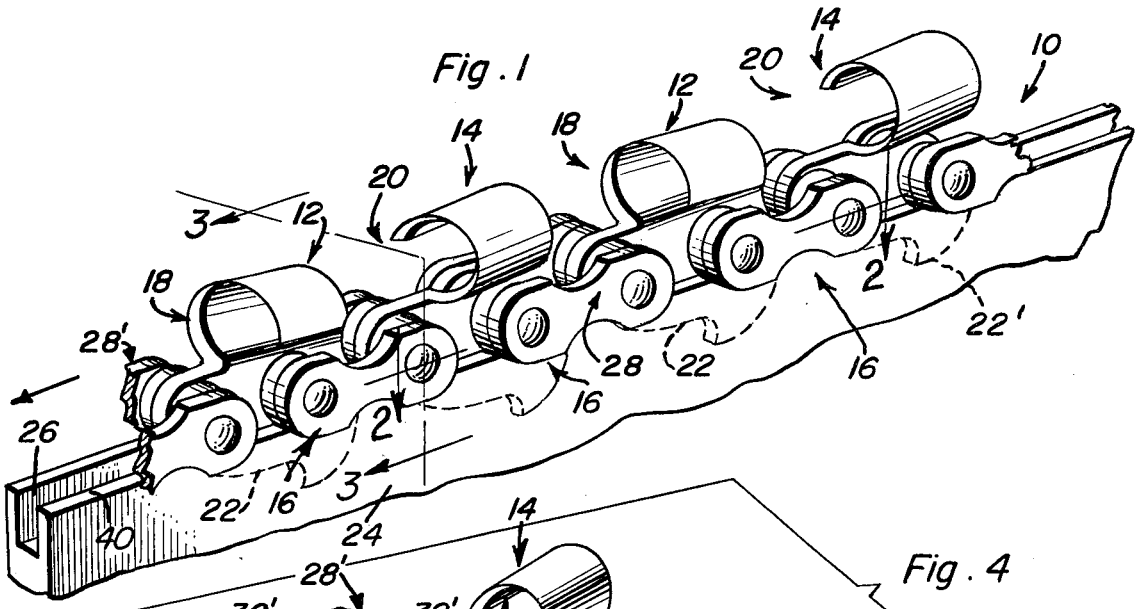
Fig. 4
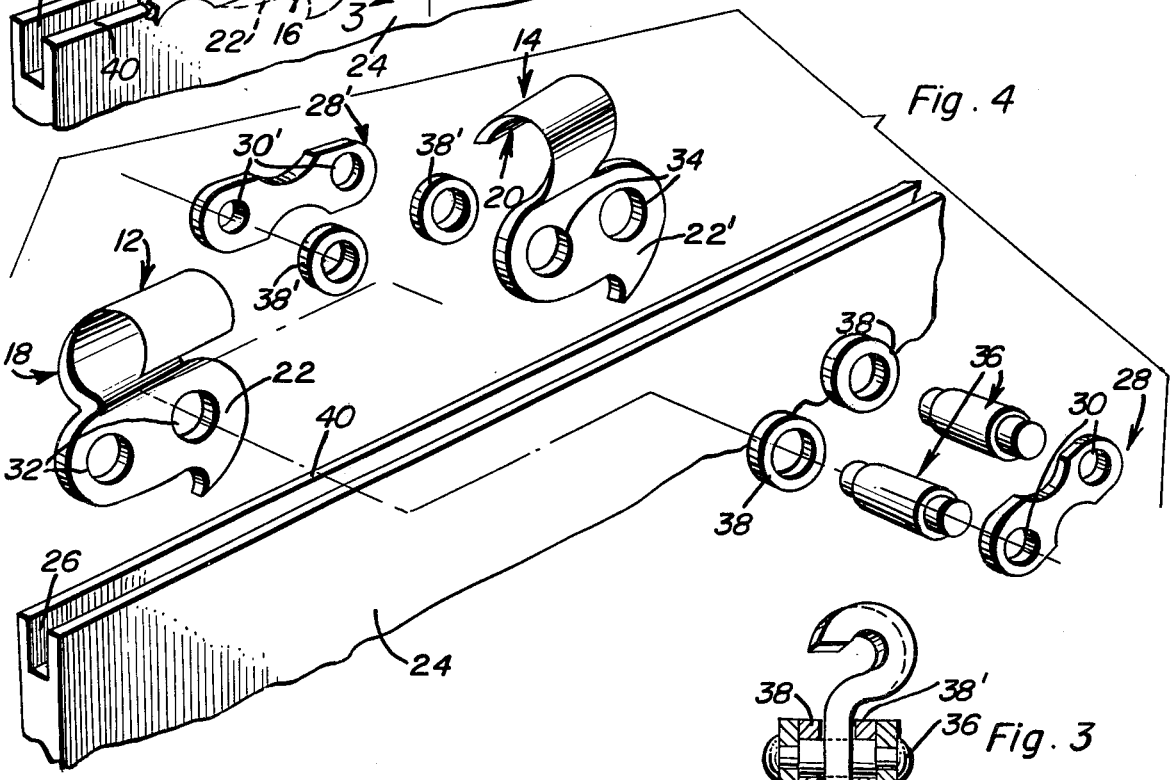
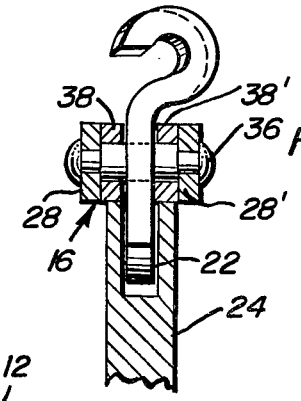
Fig. 3
Fig. 2
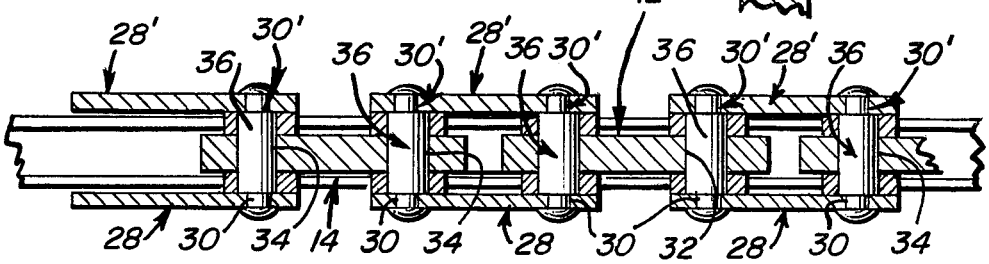

CUTTER ASSEMBLY FOR SAW CHAIN

BACKGROUND OF THE INVENTION

1. Field of the Invention

This invention relates generally to saw chains, and particularly to a link assembly for constructing a saw chain.

2. Description of the Prior Art

My prior U.S. Pat. No. 3,613,749, issued Oct. 19, 1971, discloses a saw chain with dual cutters wherein the cutting teeth are outwardly rolled in opposed fashion along the upper edges of the side-straps of the chain. While this arrangement provides for efficient cutting action, it has been found that the mounting of the cutting teeth on the side-straps, or connecting links, of the chain creates some problems with the balance of the resulting saw chain. Further, when the cutting teeth are mounted on the side-straps of the chain links, the straps themselves must generally be of such a thickness as to preclude the use of rollers in conjunction with the links, thus increasing the friction between the links or cutter or saw bar which guides the chain, and accordingly increasing the power requirements to move the chain about the saw bar.

SUMMARY OF THE INVENTION

It is an object of the present invention to provide a saw chain cutter assembly which has better balance and less friction than conventional saw chains of the general design.

It is another object of the present invention to provide a cutter assembly for a saw chain which permits the use of roller bearings in order to reduce friction between the chain and an associated saw bar.

Yet another object of the present invention is to provide a cutter assembly for a saw chain wherein each cutter and associated driver is integrally formed as a single unit.

These and other objects are achieved according to the present invention by providing a cutter assembly for a saw chain wherein the assembly has: a first cutter member; a second cutter member disposed sequentially behind the first cutter member in the direction of intended movement of the associated saw chain; and an attachment arrangement attached to the first cutter member and the second cutter member for connecting together the cutter members in alternate disposition. More specifically, the first cutter member and the second cutter member each include a cutter and a driver, with the latter being receivable in a peripheral groove of a cutter or saw bar. The cutter of the first cutter member extends away, or in the opposite transverse direction, from the extent of the cutter of the second cutter member so as to form an alternate bite in the manner of the dual cutters of the saw chain disclosed in my prior U.S. Pat. No. 3,613,749, issued Oct. 19, 1971.

The attachment arrangement preferably includes, for each cutter assembly, a pair of substantially parallel, spaced, coextensive, longitudinally extending links, with the first and second cutter members being disposed partly between the links and extending in opposite directions therefrom parallel to the longitudinal extent of the links. Each of the links is provided with a pair of apertures longitudinally spaced from one another and receiving a pair of pins arranged in opposed ones of the apertures and in openings provided in the cutter members for pivotally attaching the cutter members to the links while tying opposed pairs of the links to one another. A pair of rollers is disposed on each of the pins, with each of the rollers being disposed between the associated one of the cutter members and a respective one of the links for engagement with the surface of the cutter bar in which the peripheral groove is formed. By this arrangement, the driver of each of the cutter members will extend into the peripheral groove for guidance thereby, while the rollers disposed on either side of the cutter member will engage the outward surface of the cutter bar for providing rolling friction between the saw chain and the cutter bar.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a fragmentary, perspective view showing a saw chain constructed with cutter assemblies according to the present invention.

FIG. 2 is an enlarged, fragmentary, sectional view taken generally along the line 2—2 of FIG. 1.

FIG. 3 is an enlarged, fragmentary, sectional view taken generally along the line 3—3 of FIG. 1.

FIG. 4 is a fragmentary, exploded, perspective view showing the elements of a cutter assembly according to the present invention.

DESCRIPTION OF THE PREFERRED EMBODIMENTS

Referring now more particularly to FIGS. 1-3 of the drawing, a saw chain 10 is constructed of cutter assemblies according to the present invention, each of which cutter assembly includes a first cutter member 12 and a second cutter member 14 arranged sequentially in the direction of movement of chain 10. The direction of movement of chain 10 is indicated by the direction arrow in FIG. 1. The cutter members 12 and 14 are connected together by an attachment arrangement 16, which also connects together a plurality of the cutter assemblies in alternate disposition so as to form chain 10. More specifically, each of the cutter members 12, 14 includes a cutter 18, 20 and an associated driver 22, 22' formed from a piece of plate material, and the like, as a single unit. Chain 10 rides along a conventional saw or cutter bar 24 provided with a peripheral groove 26 arranged for receiving the drivers 22, 22' in a conventional manner. The cutters 18 extend away from the cutters 20 transversely of the longitudinal extent of chain 10 for forming an alternate bite into a member (not shown) being sawed. More specifically, cutters 18 and 20 are right-hand circular-edged cutters and left-hand circular-edged cutters, respectively, when looking along the saw chain 10 in the forward direction of movement of the chain 10. As will be appreciated, the cutters 18 and 20, although extending in opposite directions so as to provide opposed bites, have the circular portions thereof substantially coextensive from the transverse center of chain 10 so as to cut through the member being sawed. Further, the cutting edge of the cutters 18, 20 have a pitch to the wood so as to pick up a bite that will cause the cut to progress.

It also should be noted that cutters 18 and 20 are not co-axial with one another as would be true if both cutters made identical cuts. It requires both cutters to make a cut to a given depth; the right-hand cutter making one-half the depth, and the left-hand cutter completing the cut. In other words, the left-hand cutter which follows the right-hand cutter does not repeat the preceding cut, but completes it by making its additional one-half cut.

Attachment arrangement 16 includes a plurality of opposed pairs of spaced, substantially parallel, coextensive, longitudinally extending connecting links 28 and 28', with the cutter members 12 and 14 being disposed partly between and extending from the links 28 and 28'. Each of the links 28 and 28' is provided with a pair of longitudinally spaced apertures 30, 30', with corresponding openings 32, 34' being provided in the cutter members 12 and 14, respectively. A plurality of pins 36 are arranged in the apertures 30, 30' and openings 32, 34' for pivotally attaching the cutter members to the links 28, 28' while simultaneously tying the opposed pairs of the links 28, 28' to one another. The pins 36 may be in the form of the illustrated double headed rivets to assure the security of the resulting assembly.

Attachment arrangement 16 further includes a plurality of rollers 38 and 38' mounted in pairs on each of the pins 36 between the associated one of the links 28, 28' and a respective one of the cutter members 12, 14. By this arrangement, as best seen in FIG. 3, the rollers, which are larger in diameter than the height of the links 28 and 28', will engage the upper surface 40 of cutter bar 24, that being the surface in which groove 26 is provided, for reducing friction between chain 10 and cutter bar 24.

Referring now more particularly to FIG. 4 of the drawing, the elements of one of the cutter assemblies according to the present invention are shown in exploded form. As can be appreciated, this single assembly can be connected to other such assemblies and repeated so as to form a complete saw chain of any desired length.

The cutters 18, 20, each with a driver 22, 22' formed on the back thereof, are preferably set at a horizontal rake or angle with respect to the longitudinal extent of the associated links 28, 28' so as to cut itself free. In other words, the design of the cutters 18, 20 forms a built-in set that will last the life of the associated chain. The cutting edge of each cutter 18, 20 can be honed to the desired bevel, which bevel determines the amount of manual pressure to be applied to the chain saw. That is, the depth of the cut can vary because it is determined by the size of the rotary hone with which the cutter is sharpened.

The vertical-center arrangement of the cutters 18, 20 in chain 10 causes the chain 10 to be better balanced than conventional saw chains which have cutters formed on the side-straps. The pins 36 clamp the cutter-driver forming cutter members 12, 14 together to form the chain 10. They are similar to pins of conventional saw chains, except that the length of the spindle is longer. The rollers 38, 38' travel on the surface 40 of a conventional saw or cutter bar 24 along the channel or groove 26 which guides the cutter members 12, 14. Thus, the rollers 38, 38' greatly reduce friction on the cutter bar 24, and less power is required for chain 10 to be moved because these rollers 38, 38' roll along the top of the bar 24 rather than slide thereon as do the side-straps or links of conventional saw chains.

A saw chain 10 according to the present invention will be oiled as conventional chains are now lubricated by having automatic or manual oilers (not shown). Further, chain 10 can be sharpened with a rotary file (not shown) or a round power-driven hone (not shown) in the conventional manner.

As can be readily understood from the above description and from the drawing, a saw chain constructed from cutter assemblies according to the present invention provides, compared to conventional saw chains, for better balance due to the central location of the cutter teeth, greater strength due to the combination of the drivers and cutting teeth into single units, and greater operating efficiency because of the use of the roller bearings.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A cutter assembly for a saw chain for making a cut to a predetermined given depth, comprising, in combination:

(a) a first cutter member;

(b) a second cutter member arranged sequentially with respect to the first cutter member; and (c) attachment means attached to the first cutter member and the second cutter member for connecting together the first cutter member and second cutter member in sequential disposition, wherein the first cutter member and the second cutter member each include a cutter and a driver, with the latter being receivable in a peripheral groove of a cutter bar, and the cutter of the first cutter member extending away from the cutter of the second cutter member along an extent of the sequential disposition of the first cutter member and the second cutter member for forming an alternate bite for the cutter assembly, wherein the cutter of the first cutter member is a right-hand circular-edged cutter and the cutter of the second cutter member is a left-hand circular-edged cutter, respectively, looking along the assembly in an intended forward direction of movement of a chain in which the assembly is incorporated, wherein both the first and second cutter members are required to make a cut to the given depth, the right-hand cutter being adapted for making approximately one-half the depth, and the left-hand cutter being adapted for completing the cut, the cutter members being sharpenable with a round file or a round power-driven hone, wherein each of the first cutter member and the second cutter member is provided with a pair of openings, and the attachment means includes, in combination:

(1) a pair of opposed, spaced, substantially parallel, coextensive, longitudinally extending links, with the first cutter member and the second cutter member being disposed partly between the links and extending in opposite directions therefrom, each of the links being provided with a pair of longitudinally spaced apertures; and (2) a pair of pins arranged in opposed ones of the apertures and in one of the openings of an associated one of the first cutter member and the second cutter member for pivotally attaching the cutter member to the links and tying the links to one another, wherein the attachment means further includes a plurality of rollers mounted in pairs on each of the pins between an associated one of the links and a respective one of the first cutter member and the second cutter member and arranged for engagement with an associated cutter bar for providing rolling friction between the cutter assembly and the cutter bar, each pair of rollers riding on parallel ridges of the grooved cutter bar.

2. A structure as defined in claim 1, wherein the first cutter member has a cutting edge having a pitch so as to pick up a bite that will cause the cut to progress, and the second cutting member has a cutting edge having a pitch so as to pick up a bite that will cause the cut to progress.

3. A structure as defined in claim 1, wherein the pins are in the form of double headed rivets, whereby security of the cutter assembly is assured.

4. A structure as defined in claim 2, wherein the first cutter members and second cutter members are located centrally on the attachment means, whereby balanced cutting action is obtainable, and wherein each cutter and driver forms a single unit, whereby a strong cutter assembly is obtainable, and wherein said roller reduces friction between the cutter assembly and the cutter bar, whereby high operating efficiency is obtainable.

* * * * *